US007436973B2

(12) United States Patent
Liao

(10) Patent No.: US 7,436,973 B2
(45) Date of Patent: Oct. 14, 2008

(54) STRUCTURE FOR EARPHONES WITH MULTIPLE SOUND TRACKS

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 646 days.

(21) Appl. No.: 11/127,245

(22) Filed: May 12, 2005

(65) Prior Publication Data

US 2006/0256992 A1 Nov. 16, 2006

(51) Int. Cl.
*H04R 25/00* (2006.01)

(52) U.S. Cl. ..... 381/370; 381/371; 381/373

(58) Field of Classification Search ..... 381/71.6, 381/309, 322, 326, 345, 346, 350, 351, 370–374, 381/376; 379/430, 431, 432
See application file for complete search history.

(56) References Cited

U.S. PATENT DOCUMENTS 4,005,278 A * 1/1977 Gorike ..... 381/373
2002/0090101 A1* 7/2002 Ma ..... 381/322
2005/0105755 A1* 5/2005 Yueh ..... 381/371

* cited by examiner

*Primary Examiner*—Brian Ensey
(74) *Attorney, Agent, or Firm*—Rosenberg, Klein & Lee

(57) ABSTRACT

A structure for earphones with multiple sound tracks, includes an earphone casing, at least one first speaker, a second speaker and an adjusting member. The earphone casing has a plurality of outer-sound holes on the outside portion thereof. The speakers are disposed in the earphone casing. The speakers face outwards. The adjusting member is disposed on the earphone casing. The adjusting member has a plurality of adjusting holes corresponding to the outer sound holes of the earphone casing so that the adjusting holes of the adjusting member and the outer sound holes of the earphone casing can be aligned or staggered to reduce the sound pressure and reduce the discomfort for a user, thereby reducing hearing damage and loss. Furthermore the device has the functions of earphones, a loud speaker, a sound box and an earphone device with multiple sound tracks.

13 Claims, 13 Drawing Sheets

STRUCTURE FOR EARPHONES WITH MULTIPLE SOUND TRACKS

BACKGROUND OF THE INVENTION

1. Field of the Invention

The present invention relates to a structure for earphones with multiple sound tracks, and more particularly, to an earphone device that reduces hearing loss by a user and can function as earphones, speakers and a sound box.

2. Description of Related Art

Earphones are a common device used when listening to audio devices such as an MP3 player, a Walkman, a radio or a cell phone.

Referring to FIG. 1, a conventional earphone 9 consists of an earphone casing 91 and an inside facing speaker92. The speaker 92 is connected to a signal line 93. The signal is transmitted to the speaker 92 to make the speaker 92 produce sound. Thereby the sound is audible to a user.

However, the above speaker or earphones that use similar types of speakers, face inside. The sound wave emitted by the speaker is directly transmitted to the ear of the user, causing the ear drum of the user to become uncomfortable and which, over extended periods or due to exposure to high volumes, cause the user to suffer from hearing loss.

In addition, a conventional earphone has relatively simple functions. However, with the development of modern technologies and multi-media, it the conventional earphone is becoming inapt. Particularly, people also desire a loud speaker or a sound box for listening to music at other times, thereby necessitating the need to purchase other such devices. This is both more expensive and inconvenient for the user.

Accordingly, as discussed above, the prior art still has some drawbacks that could be improved upon. The present invention aims to resolve the drawbacks in the prior art.

SUMMARY OF THE INVENTION

An objective of the present invention is to provide a structure for earphones with multiple sound tracks that is comfortable, decreases the sound pressure, and reduces damage to the user's ear drum thereby preventing hearing loss. The device can also function as earphones, a loud speaker and a sound box. Furthermore, it offers multiple sound tracks.

For achieving the objectives above, the present invention provides a structure for earphones with multiple sound tracks, comprising: an earphone casing having an outside portion and an inside portion, the outside portion having a plurality of outer sound holes thereon; at least one first speaker and at least one second speaker fixed in an inner part of the earphone casing, wherein the first speaker and the second speaker are arranged to face the outside portion of the earphone casing; and an adjusting member disposed on the earphone casing for opening or closing the outer sound holes.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
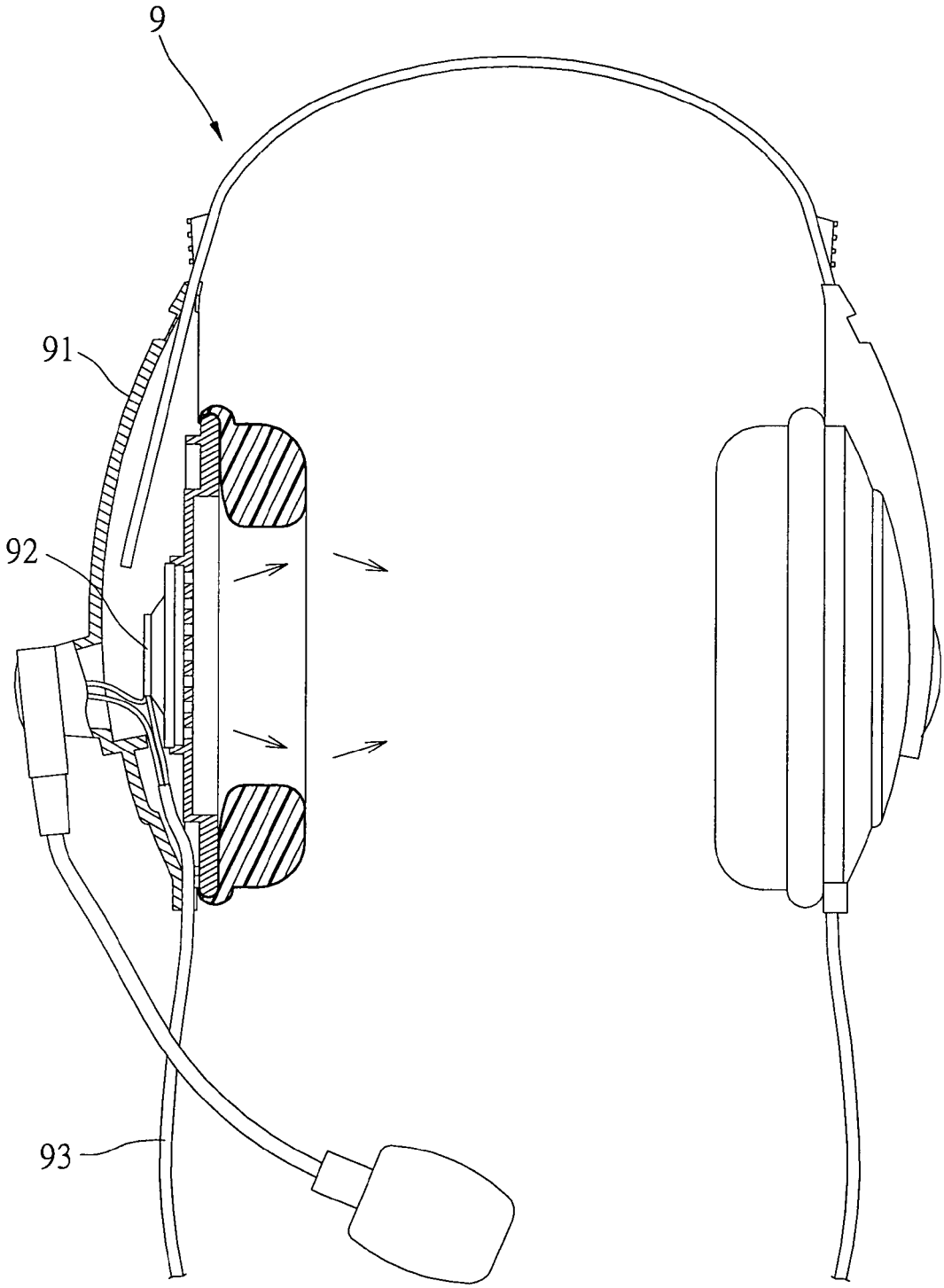
FIG. 1 PRIOR ART
FIG. 1 is a cross-sectional view of the prior art.
Figure 2:
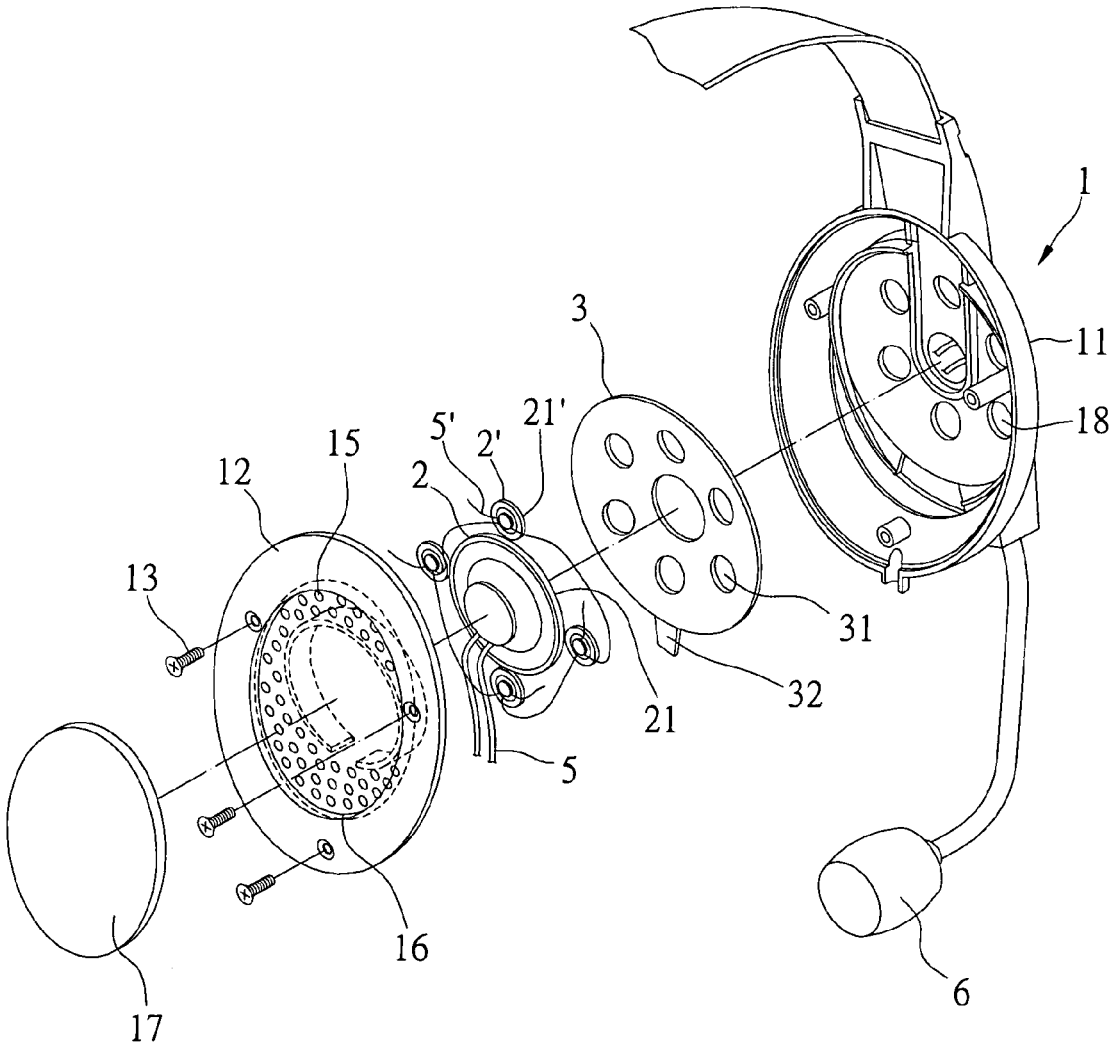
FIG. 2 is an exploded view of the first embodiment of the present invention.
Figure 3:
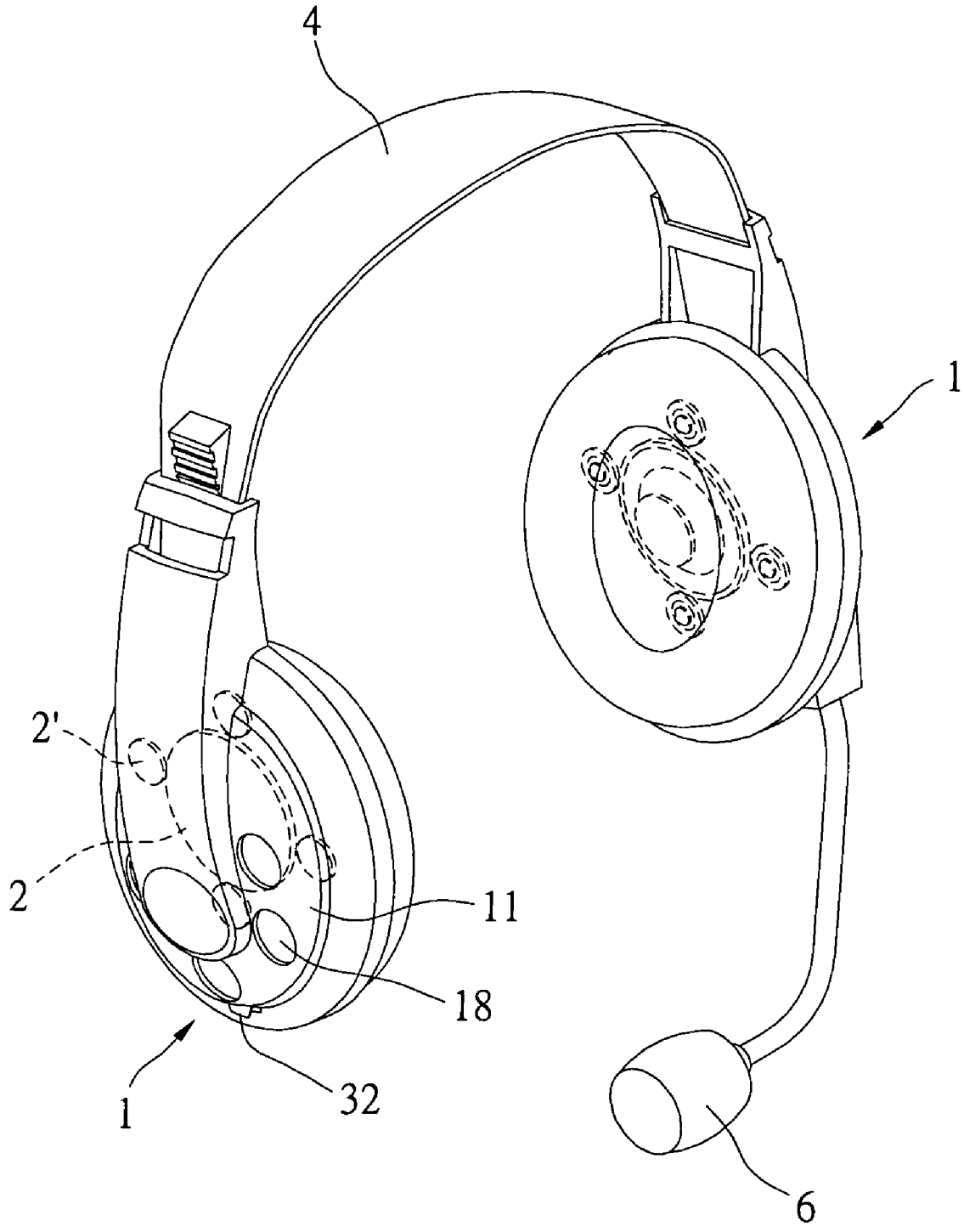
FIG. 3 is a perspective view of the first embodiment of the present invention.
Figure 4:
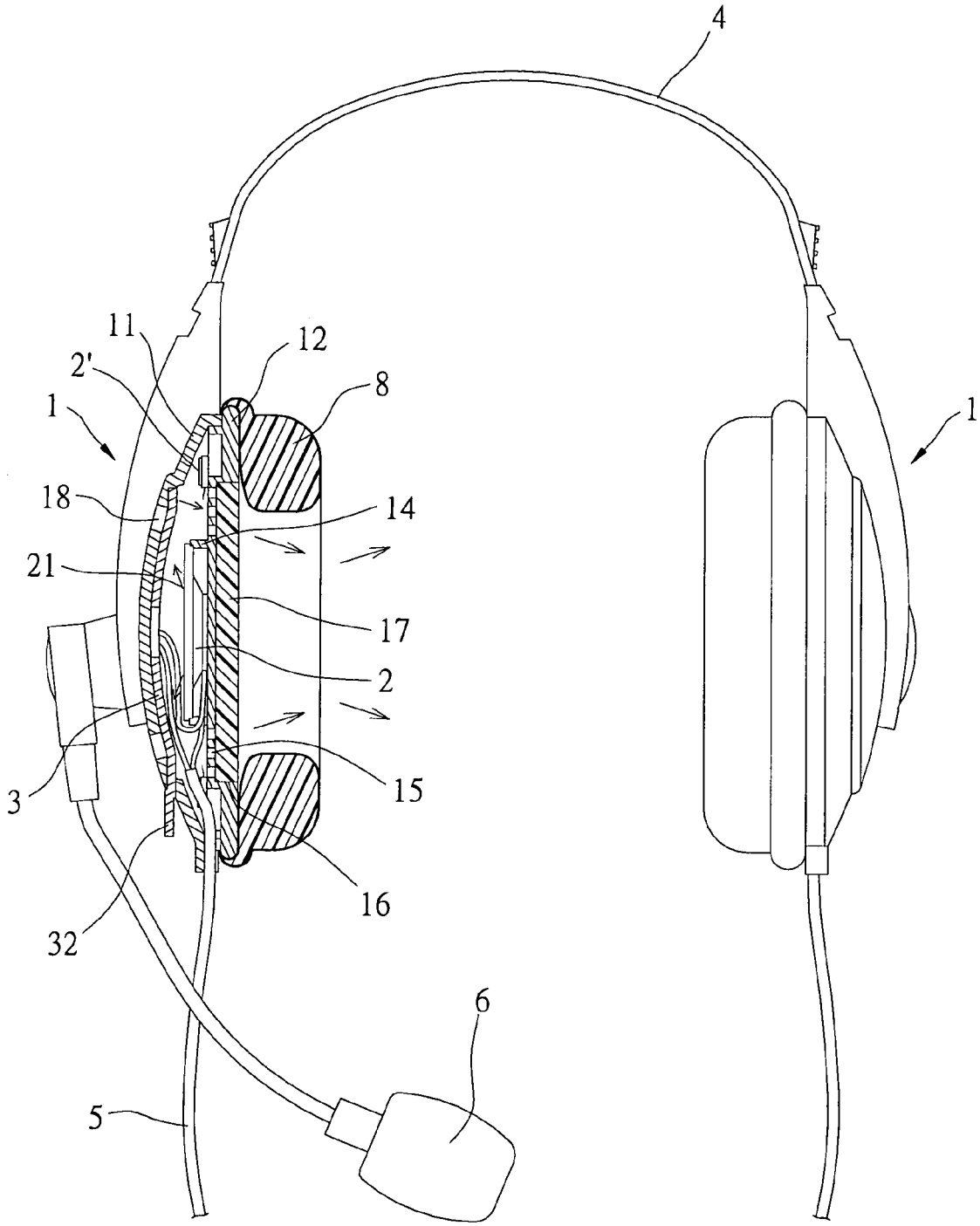
FIG. 4 is a cross-sectional view of the first embodiment of the present invention.

Referring to FIGS. 2 to 4, the present invention provides a structure for earphones with multiple sound tracks; it is not limited to any type of earphone. In this embodiment, an earphone device for headphones is disclosed. The headphones include two earphone casings 1, two first speakers 2, a plurality of second speakers 2' and two adjusting members 3. The two earphone casings 1 are connected by a head support 4. The earphones are attached to the head of a user by the head support 4. The two first speakers 2, a plurality of second speakers 2' and two adjusting members'3 are disposed in the two earphone casings.

Figure 9:
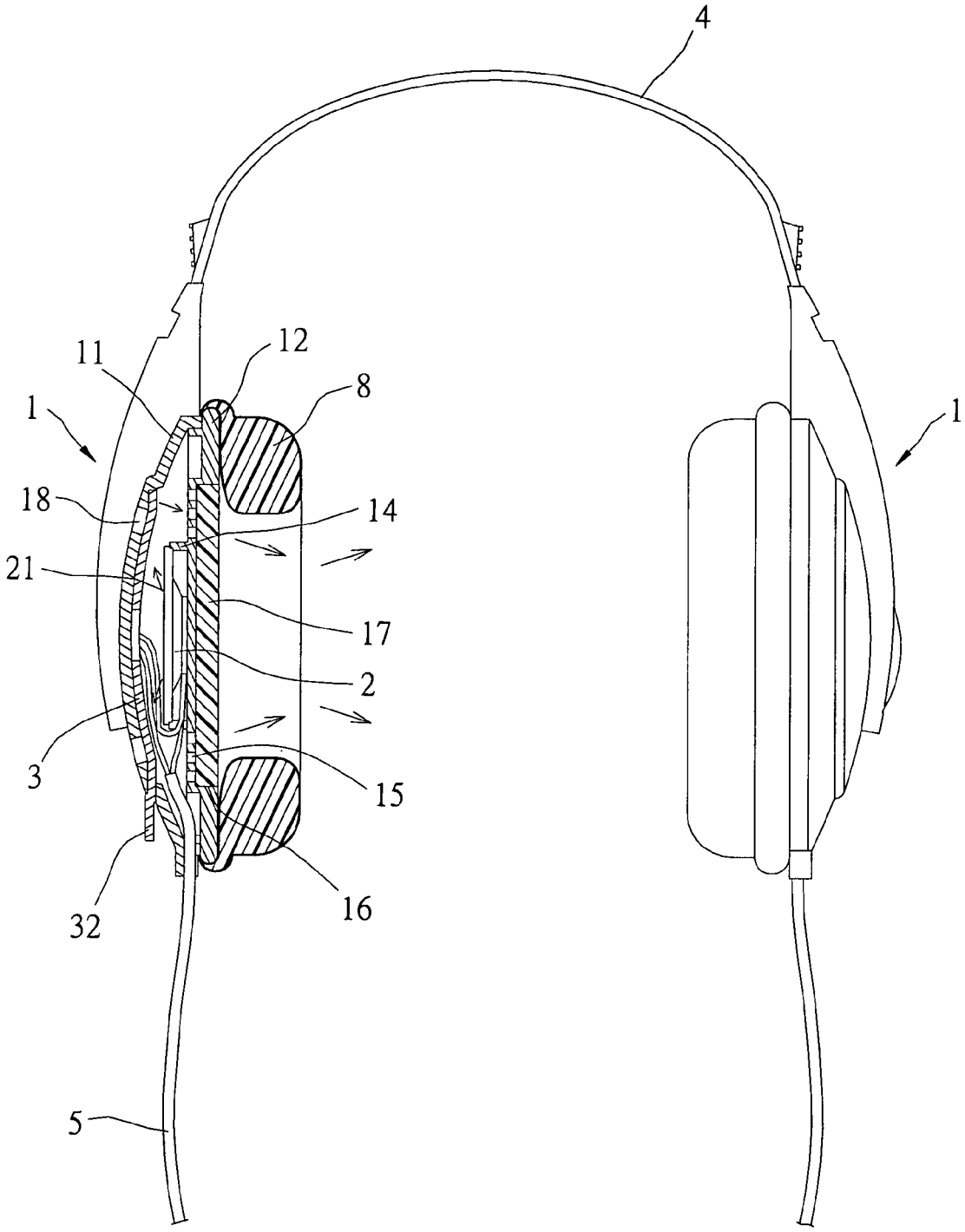
FIG. 9 is a cross-sectional view of the fifth embodiment of the present invention.

The earphone casing consists of an outside portion 11 and an inside portion 12. The outside portion 11 and the inside portion 12 are combined by clamping or tightening screws 13 to form the earphone casing 1. The earphone casing 1 has a circular fixed seat 14 in the inside portion 12 thereof. The inside portion 12 has a plurality of inner sound holes 15 thereon. The inner sound holes 15 penetrate to the inside portion 12. The earphone casing 1 has a slot 16 in the outer part of the inside portion 12 thereof. The slot 16 has a sponge 17, which is disposed on the inner-sound hole 15. The outside portion 11 has a plurality of outer sound holes 18 thereon. The outer sound holes 18 penetrate to the outside portion 11. The outside portion 11 of the earphone casing 1 is connected to a microphone 6. The inside portion 12 of the earphone casing 1 is connected to a soft material 8. The microphone 6 is not shown in FIG. 9.

The first speaker 2 is disposed in the fixed seat 14. The first speaker 2 is disposed in the fixed seat 14 by binding or clamping methods so that the first speaker 2 is disposed in the earphone casing 1. The head surface 21 of the first speaker 2 faces the outside portion 11 of the earphone casing 1. The first speaker 2 is connected with a signal line 5 or a circuit board. The sound waves from the first speaker 2 are emitted through the outer sound holes 18 or the inner sound holes 15 and the volume is controlled via the adjusting member 3.

The second speakers 2' are smaller in size than the first speakers 2 and are disposed on the outer part of the first speaker 2. The second speakers 2' are disposed in the fixed seat 14 by binding or clamping methods so that the first speaker 2 is disposed in the earphone casing 1. The head surface 21' of the second speakers 2' faces the outside portion 11 of the earphone casing 1. The second speakers 2' are connected by a signal line 5' or a circuit board. The sound waves of the second speaker 2' are emitted via the outer sound holes 18 or the inner sound holes 15 and the volume is controlled via the adjusting member 3.

The adjusting member 3 can be formed in a circular shape or in any other shape. The adjusting member 3 is rotatable disposed in the earphone casing 1. The adjusting member 3 has a plurality of adjusting holes 31 thereon relative to the outer sound holes 18 of the earphone casing 1. The adjusting member 3 has a button 32 disposed upon it. The button 32 penetrates out through the earphone casing 1 so that the user is able to turn the adjusting member 3 via the button 32 so that the adjusting holes 31 of the adjusting member 3 and the outer sound holes 18 of the earphone casing 1 are aligned or staggered; thereby the multiple sound tracks earphone device of the present invention is formed.

Referring to FIG. 4, as the adjusting holes 31 of the adjusting member 3 and the outer sound holes 18 of the earphone casing 1 are staggered (FIG. 2), the outer sound holes 18 of the earphone casing are closed by the adjusting member 3 so that the sound wave of the first speaker 2 and the second speakers 2' are sent out from the inner-sound hole 15 of the earphone casing 1 by reflecting off from the outside portion 11 of the closed earphone casing 1 and the adjusting member 3; thereby reducing the sound pressure and any discomfort for a user, and preventing hear loss or damage. In addition, the present invention has a plurality of the first speakers 2 and the second speakers 2', thus it has multiple sound tracks and stereophonic features.

Figure 5:
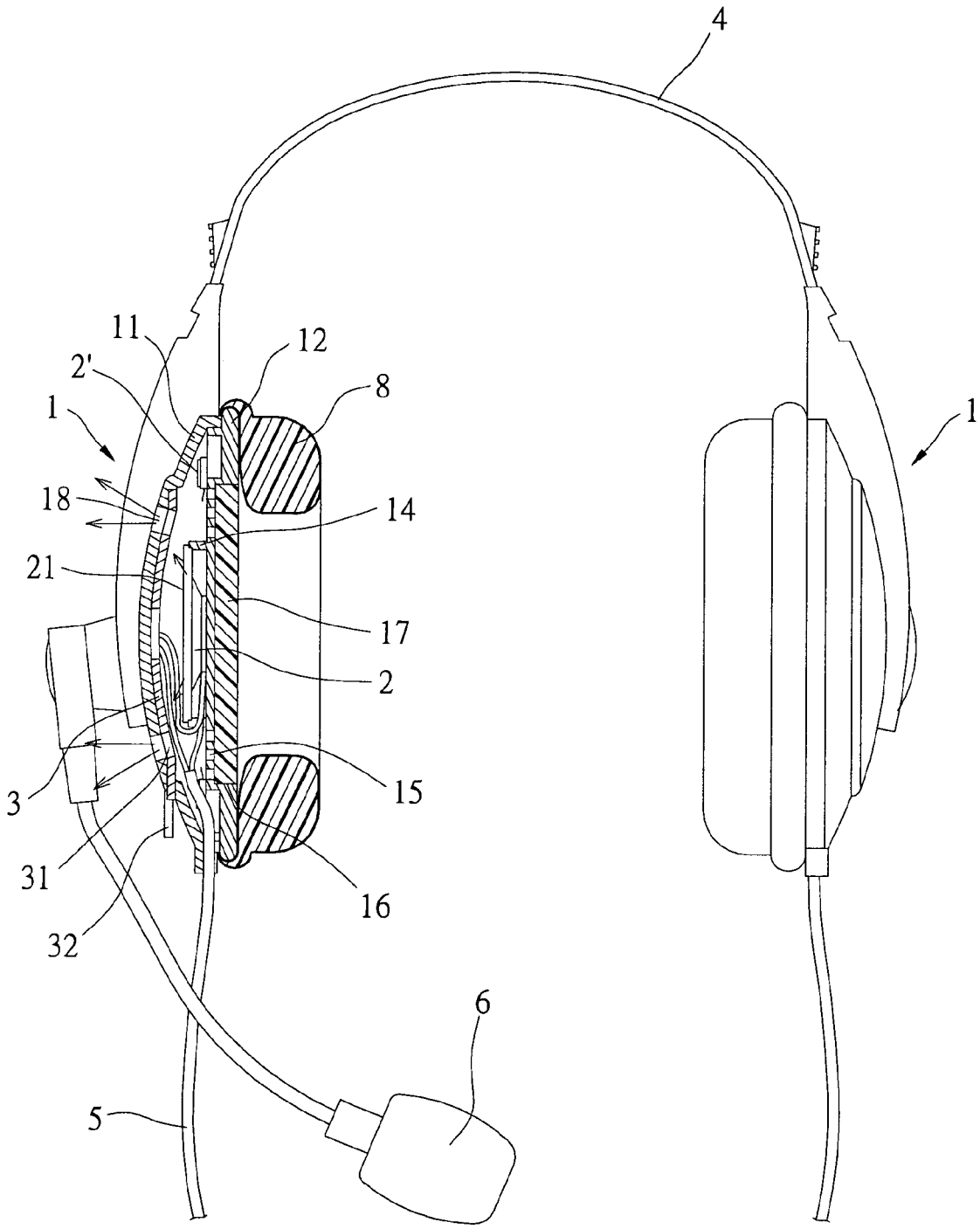
FIG. 5 is a cross-sectional view of the first embodiment of the present invention.

Referring to FIG. 5, as the adjusting holes 31 of the adjusting member 3 and the outer sound holes 18 of the earphone casing 1 are aligned, the outer sound holes 18 of the earphone casing are opened, so the sound waves from the first speaker 2 and the second speakers 2' are sent out via the outer sound holes 18 on the outside portion 11 of the earphone casing 1. Thereby the device has the functions of a loud speaker and a sound box.

Figure 6:
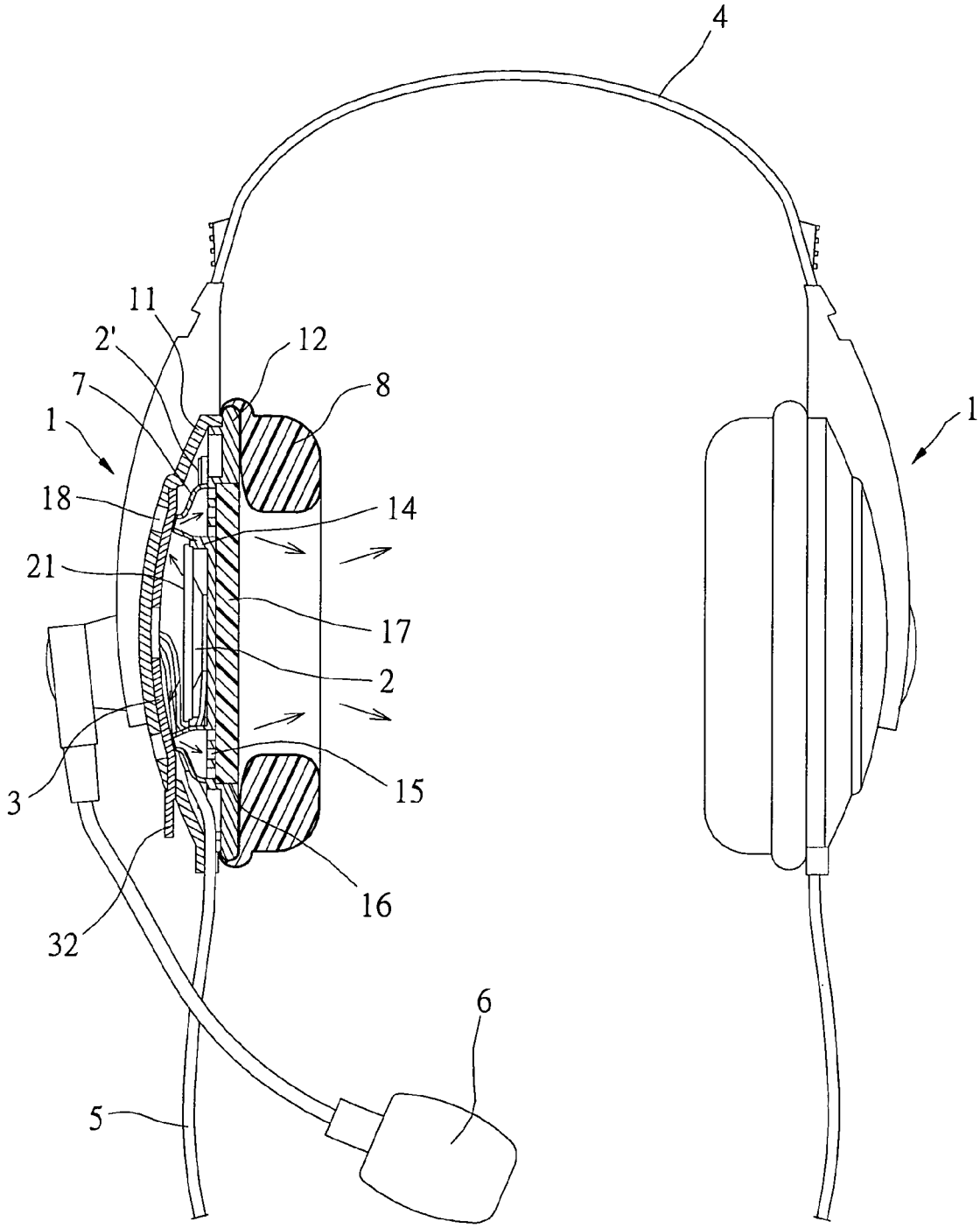
FIG. 6 is a cross-sectional view of the second embodiment of the present invention.
Figure 6A:
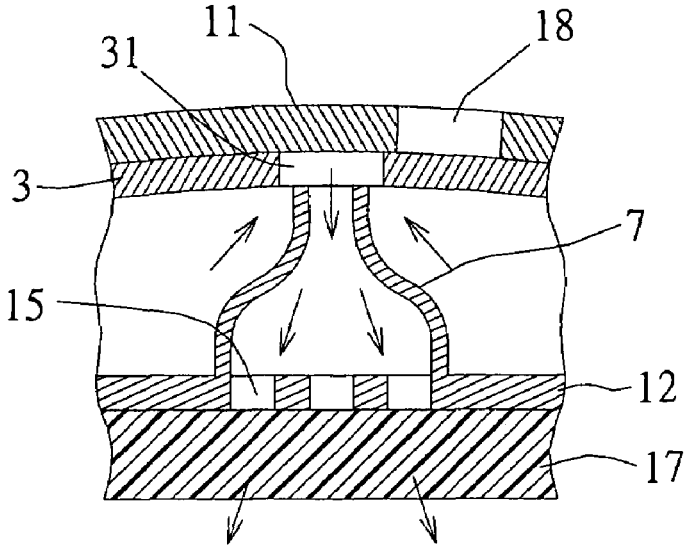
FIG. 6A is a cross-sectional view of the second embodiment of the present invention.
Figure 6B:
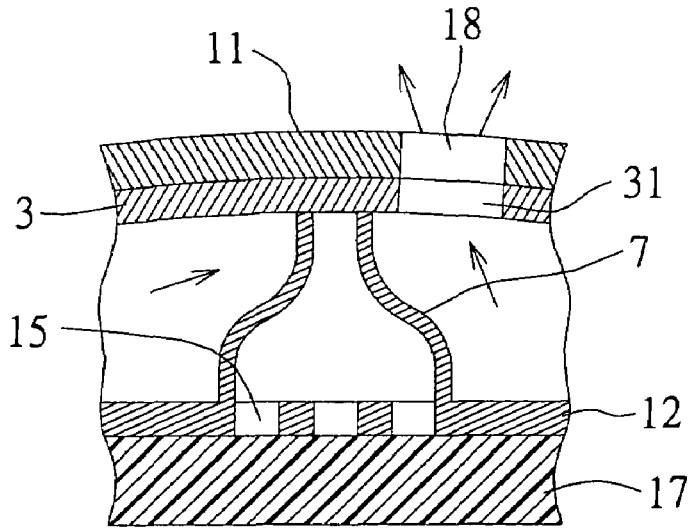
FIG. 6B is a cross-sectional view of the second embodiment of the present invention.

Referring to FIG. 6 and FIG. 6A, the inner part of the earphone casing 1 has a sound-guiding pipe 7, and two ends of the sound-guiding pipe 7 are formed openly. The two ends of the sound guiding pipe 7 face inwards and outwards respectively. When the adjusting holes 31 of the adjusting member 3 and the outer sound holes 18 of the earphone casing 1 are staggered, the outer sound holes 18 of the earphone casing are closed via the adjusting member 3 so that the sound waves from the first speaker 2 and the second speakers 2' are sent out via the sound-guiding pipe 7 to the inner sound holes 15 of the earphone casing 1 by reflection. Referring to FIG. 6B, when the adjusting hole 31 of the adjusting member 3 and the outer sound hole 18 of the earphone casing 1 are aligned, the outer part of the outer sound holes 18 of the adjusting member 3, the outer sound hole 18 of the earphone casing 1 are opened without the sound-guiding pipe 7, the sound waves from the first speakers 2 and second speakers 2' are sent out via the outer sound holes 18 disposed on the outside portion 11 of the earphone casing 1. Thereby the device has the functions of a loud speaker and a sound box.

Figure 7:
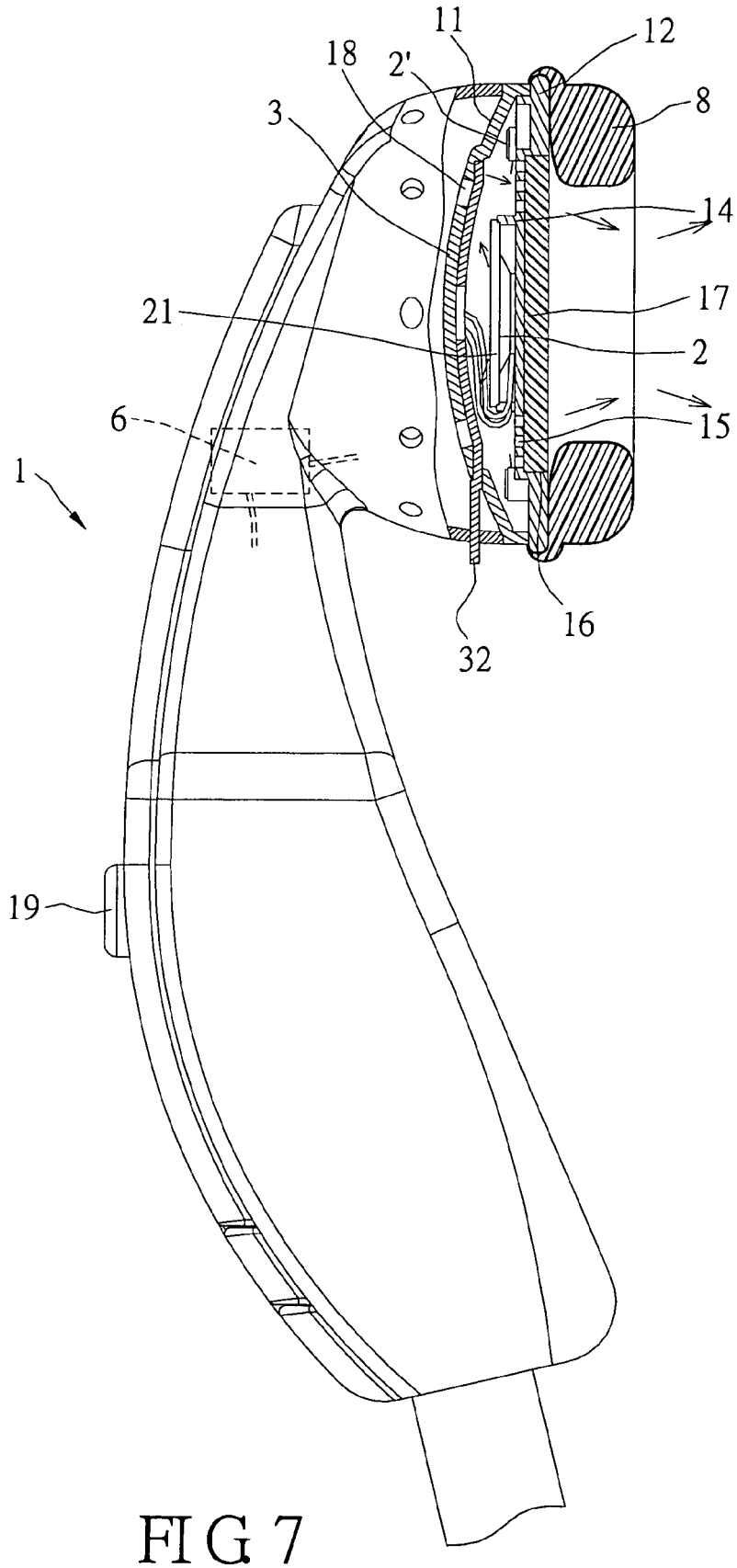
FIG. 7 is a cross-sectional view of the third embodiment of the present invention.
Figure 8:
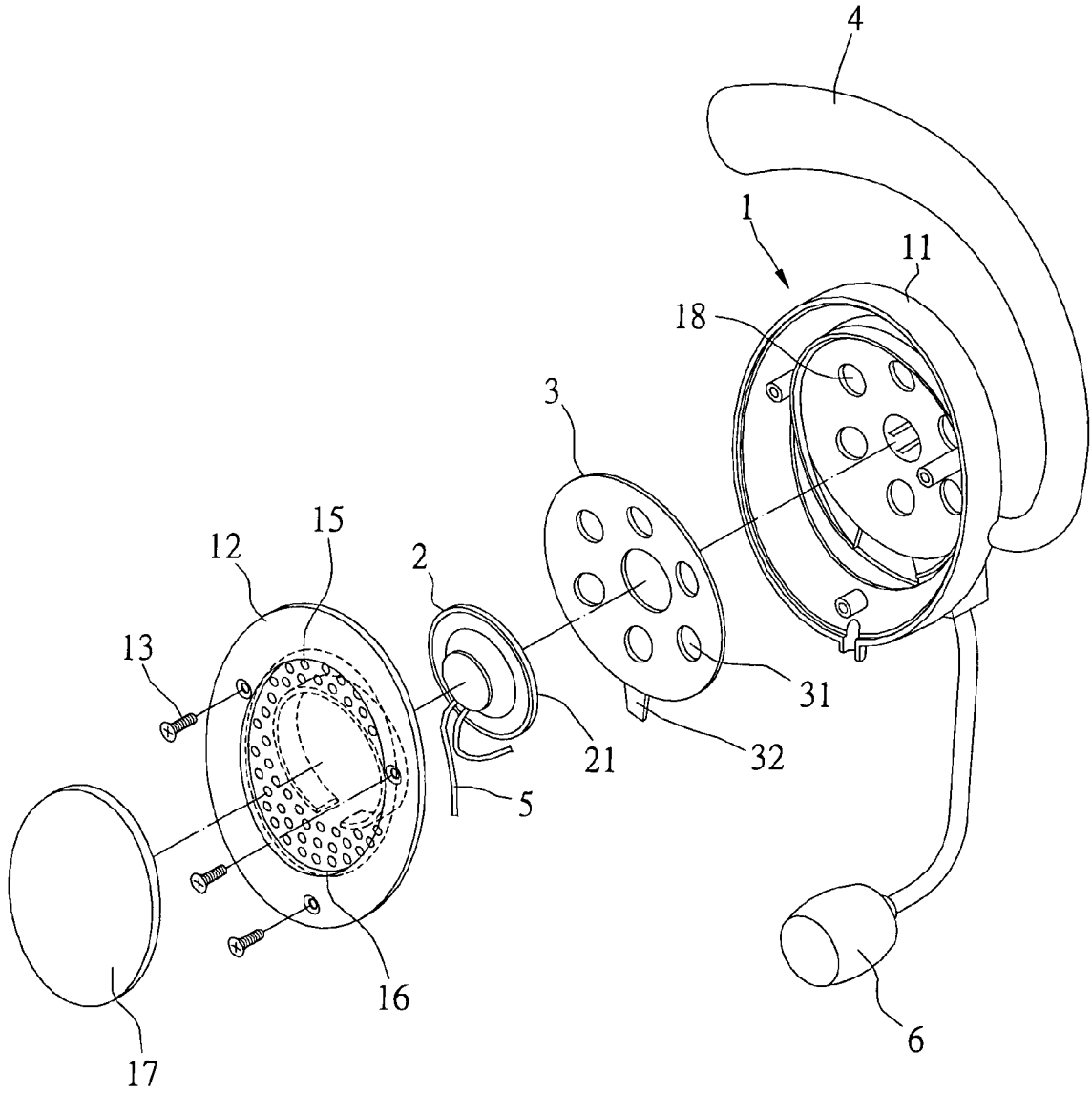
FIG. 8 is an exploded view of the fourth embodiment of the present invention.
Figure 10:
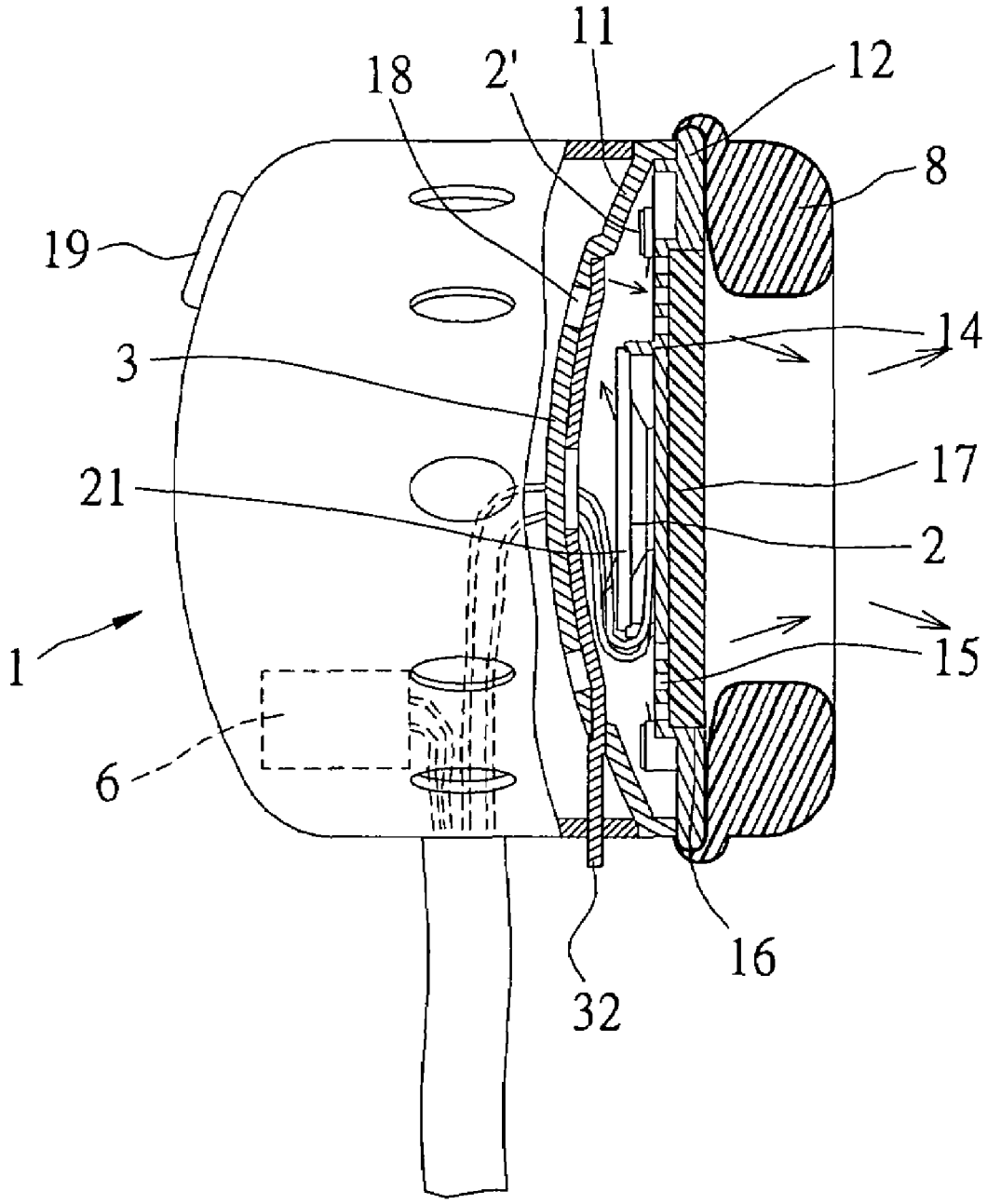
FIG. 10 is a cross-sectional view of the sixth embodiment of the present invention.
Figure 11:
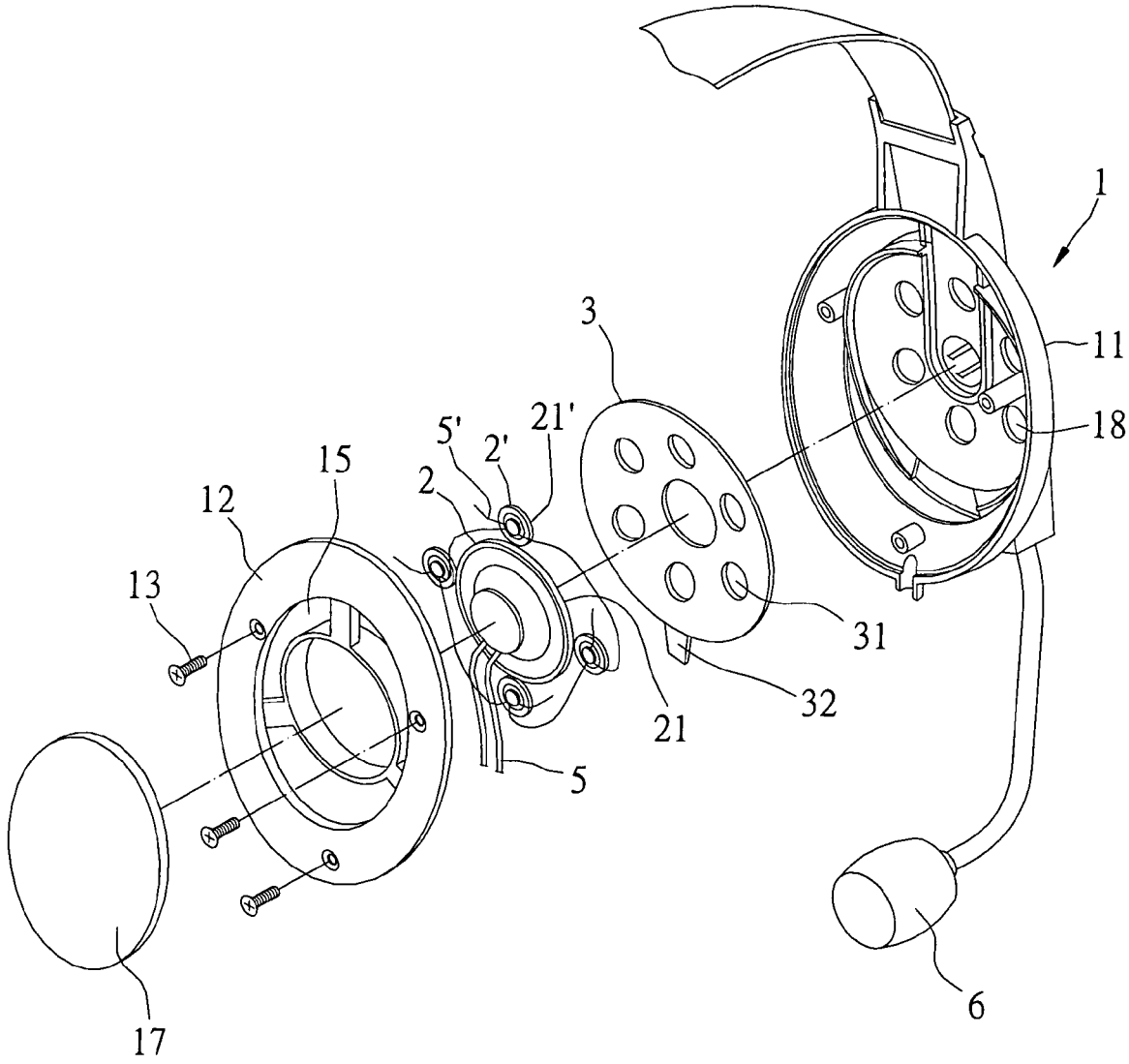
FIG. 11 is an exploded view of the seventh embodiment of the present invention.
Figure 12:
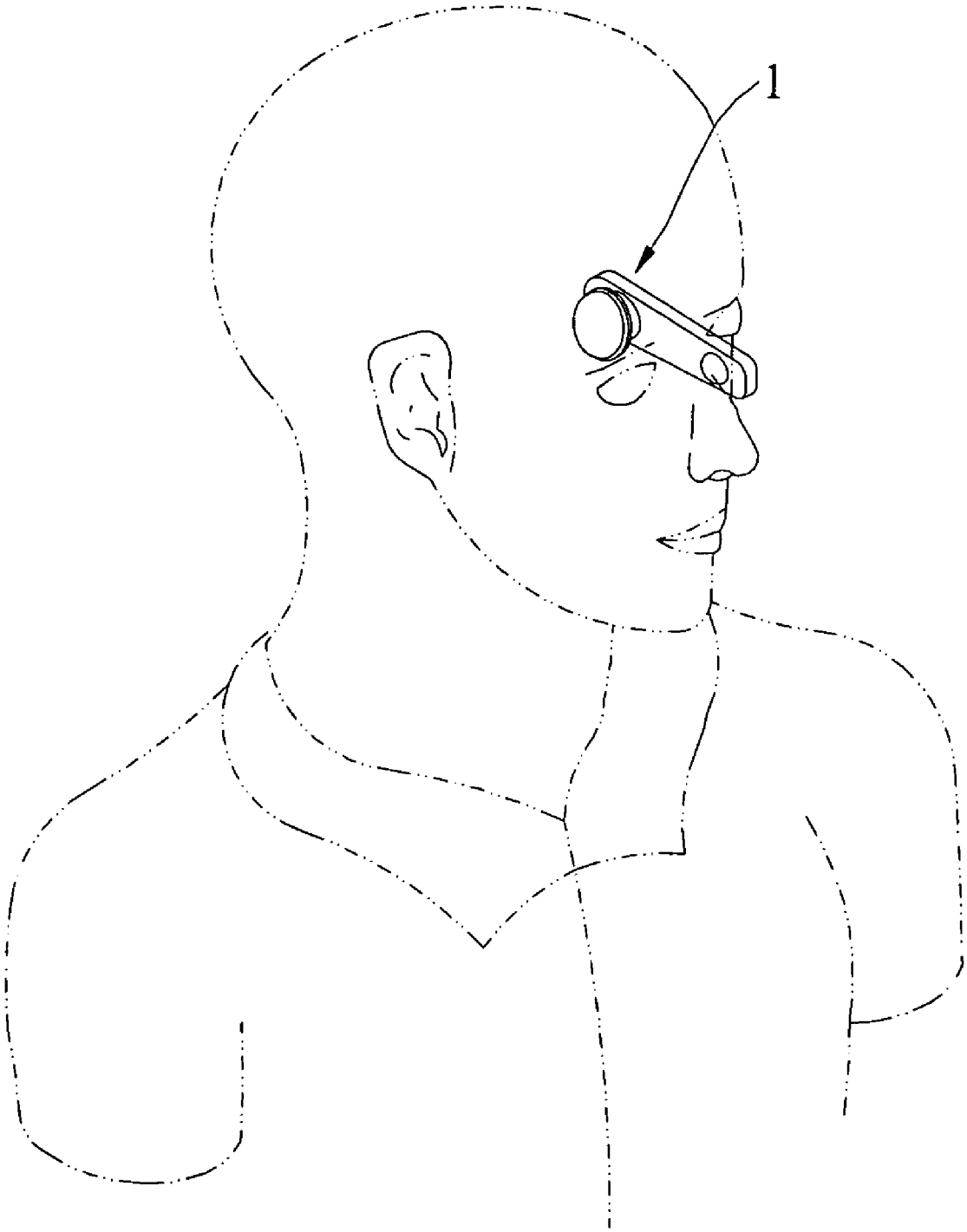
FIG. 12 is a perspective view of the eighth embodiment of the present invention.

In addition, the present invention can also use an earplug (as shown in FIG. 7 and FIG. 10) or an ear-suspended earphone (FIG. 8). Referring to FIG. 7, the microphone 6 is disposed in the earphone casing 1. The earphone casing 1 has a switch 19 thereon for controlling the operation of the first speaker 2, the second speaker 2' and the microphone. Moreover, the shape and structure of the inside portion 12 of the earphone casing 1 and the inner-sound hole 15 of the present invention can vary (see FIG. 11). Furthermore, the earphone of the present invention can be a Blue tooth or a wireless earphone type (see FIG. 12).

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A structure for earphones with multiple sound tracks, comprising:

an earphone casing having an outside portion and an inside portion, and the outside portion having a plurality of outer sound holes thereon;

at least one first speaker and at least one second speaker fixed in an inner part of the earphone casing, wherein the first speaker and the second speaker are arranged to face the outside portion of the earphone casing; and an adjusting member disposed on the earphone casing for opening or closing the outer sound holes.

2. The structure as claimed in claim 1, wherein the outside portion and the inside portion of the earphone casing are combined by clamping or screwing methods.

3. The structure as claimed in claim 1, wherein the earphone casing has a fixed seat in the inside portion thereof and the first speaker is disposed in the fixed seat.

4. The structure as claimed in claim 1, wherein the earphone casing has a microphone in the outside portion or the inner portion thereof.

5. The structure as claimed in claim 1, wherein the earphone casing has a plurality of inner sound holes on the inside portion thereof and the inner sound holes are penetrated the inside portion, and the earphone casing has a slot in an outer portion of the inside portion thereof and a sponge is placed in the slot for covering the inner sound holes.

6. The structure as claimed in claim 1, wherein the earphone casing has a sound-guiding pipe in the inner thereof.

7. The structure as claimed in claim 1, wherein the first speaker is connected with a signal line or a circuit board.

8. The structure as claimed in claim 1, wherein the second speaker is connected with a signal and a circuit board.

9. The structure as claimed in claim 1, wherein the adjusting member is rotatably disposed in the inner portion of the earphone casing, the adjusting member has a button projected therefrom, and the button is exposed outwards to an outer portion of the earphone casing.

10. The structure as claimed in claim 1, wherein the adjusting member has a plurality of adjusting holes corresponding to the outer sound holes of the earphone casing so that the adjusting holes of the adjusting member and the outer sound holes of the earphone casing can be aligned or staggered.

11. The structure as claimed in claim 1, which is a headphone, further comprising two earphone casings, two first speakers, a plurality of second speakers and two adjusting members, the two earphone casings are connected by a head support, the two first speakers, a plurality of second speakers and two adjusting members are disposed in the two earphone casings.

12. The structure as claimed in claim 1, further including an earplug or an ear-suspended earphone.

13. The structure as claimed in claim 1, further including a Blue tooth or a wireless earphone.

* * * * *